US005748206A

United States Patent [19]

Yamane

[11] Patent Number: 5,748,206

[45] Date of Patent: May 5, 1998

[54] PRINTER

[75] Inventor: Toshiyuki Yamane, Chiryu, Japan

[73] Assignee: Brother Kogyo Kabushiki Kaisha, Nagoya, Japan

[21] Appl. No.: 766,345

[22] Filed: Dec. 16, 1996

[30] Foreign Application Priority Data

Jan. 24, 1996 [JP] Japan ..... 8-031446

[51] Int. Cl.[6] ..... B41J 23/00; B41J 21/16

[52] U.S. Cl. ..... 347/37; 400/279

[58] Field of Search ..... 347/37, 14, 19; 400/279, 322, 323

[56] References Cited

U.S. PATENT DOCUMENTS

| | | | |
|---|---|---|---|
| 4,459,050 | 7/1984 | Goldberg et al. | 400/279 |
| 4,777,609 | 10/1988 | Cavill et al. | 395/105 |
| 5,310,272 | 5/1994 | Nishizama | 400/279 |
| 5,439,301 | 8/1995 | Nishizama | 400/124.05 |

*Primary Examiner*—Benjamin R. Fuller
*Assistant Examiner*—Thinh Nguyen
*Attorney, Agent, or Firm*—Oliff & Berridge, PLC

[57] ABSTRACT

The variation is the moving speed of a carriage, mainly due to the variation of the mass of the carriage with the consumption of ink, is corrected every printing cycle to enhance the accuracy of printing. PWM values for an acceleration period and a constant-speed period are examined to see if the PWM values are appropriate every printing cycle. A moving speed in the present acceleration period is compared with a first desired moving speed. When the moving speed is lower than the first desired moving speed, the PWM value is incremented by 1 to increase the duty factor of a PWM signal to be given to a CR motor in the next acceleration period. A maximum and a minimum moving speed are measured in the present constant-speed period, the maximum and the minimum moving speed are compared with a second desired traveling speed, or a maximum and a minimum allowable moving speed, and a PWM value for the next constant-speed period is determined on the basis of the comparison.

23 Claims, 9 Drawing Sheets

PRINTER

BACKGROUND OF THE INVENTION

1. Field of the Invention

The invention relates to a printer provided with a print head for printing images on a recording medium and capable of correcting the variation of the traveling speed of the print head to improve print quality.

2. Description of Related Art

In a known serial thermal printer, a carriage mounting a print head is driven for movement by a direct current motor (hereinafter referred to as "DC motor") in a pulse width modulation control (hereinafter referred to as "PWM control") mode. The operating speed of the DC motor, during acceleration and constant-speed operation, is controlled by varying the duty factor of a pulse signal applied to the DC motor.

FIG. 1 shows the variation of the operating speed of the DC motor with time. As shown in FIG. 1, in an acceleration period between time T=0, when the DC motor is started, and time $T=T_0$, when the operating speed of the DC motor reaches a desired operating speed $V_0$, the duty factor of the pulse signal is kept constant. After the operating speed has reached the desired operating speed $V_0$, the operating speed of the DC motor is controlled in a feedback control mode so that the duty factor of the pulse signal is decreased when the operating speed exceeds the desired operating speed $V_0$, and the duty factor is increased when the operating speed decreases below the desired operating speed $V_0$. The value of the duty factor is read from a storage device storing control parameters representing the relationship between the operating speed of the DC motor and the duty factor.

In this known printer, the load on a carriage driving mechanism varies with the variation in resistance against an operation for taking up an ink ribbon mounted on the print head and with an increase in the frictional resistance of bearings due to deficient lubrication. Therefore, the control of the operating speed of the DC motor, based on the fixed control parameters, is unable to adjust for such variations in the load. Consequently, it is possible that the carriage cannot be positioned at a predetermined printing position because the traveling speed of the carriage cannot be increased to a desired traveling speed before the carriage reaches a predetermined printing position.

A printer previously proposed to enable the control of the duty factor based on the control parameters, to adjust to the variation in the load, is provided with a test switch which is operated to set a storage device storing control parameters in a rewritable state, and writes new control parameters on the basis of a measured operating speed.

This previously proposed printer is able to rewrite the control parameters only when the test switch is operated. Therefore, the printer is unable to control the traveling speed of the carriage according the delicate variation of the load during the movement of the carriage.

Particularly, in an ink-jet printer, which jets ink particles onto a recording medium for printing, provided with a carriage carrying a print head and an ink supply means for supplying ink to the print head, such as an ink cartridge, the mass of the carriage varies with the variation in the quantity of ink contained in the ink cartridge. For instance, the mass of the carriage decreases every time the print head jets ink particles and thereby the load on a DC motor for driving the carriage decreases.

Consequently, the operating speed of the DC motor at the next start rises and the carriage cannot be correctly positioned at the printing position.

The effect of such a problem is significant when the ink cartridge is filled up because the weight of the full ink cartridge is about three times that of the empty ink cartridge and the load on the DC motor varies at a high rate.

SUMMARY OF THE INVENTION

Accordingly, it is an object of the invention to provide a printer capable of correcting the traveling speed of its carriage so that the carriage travels at a desired traveling speed for every printing cycle to enhance print quality.

With the foregoing object in view, the invention provides a printer comprising a print head that travels along a recording medium to print images on the recording medium, a motor for driving the print head for movement, a motor control unit for controlling the operating speed of the motor, a moving speed detector for detecting the traveling speed of the print head, and a motor speed corrector which compares the moving speed of the print head detected by the moving speed detector with a predetermined desired moving speed, and makes the motor speed corrector correct the operating speed of the motor on the basis of the result of the comparison to provide a desired operating speed to which the motor control unit adjusts the operating speed of the motor in the next printing cycle.

According to the invention, the motor speed corrector may comprise a first motor speed correcting unit which compares a maximum moving speed of the print head during movement of the print head for a predetermined distance from a starting position with a first desired moving speed and corrects the operating speed of the motor on the basis of the comparison to provide a desired operating speed at which the motor is to operate during movement of the print head for the predetermined distance from the starting position in the next printing cycle, and a second motor speed correcting unit which compares the moving speed of the print head after the print head has traveled the predetermined distance with a predetermined second desired moving speed and corrects the operating speed of the motor to provide a desired operating speed at which the motor is to operate during movement of the print head after the print head has traveled the predetermined distance in the next printing cycle.

According to the invention, the motor may be driven by a pulse signal, and the motor speed corrector may change the duty factor of the pulse signal to correct the operating speed of the motor.

According to the invention, the print head travels in the succeeding printing cycle in the same direction of movement as that in which the print head traveled in the preceding printing cycle.

According to the invention, the print head may be an ink-jet print head capable of jetting ink particles onto a recording medium and provided with an ink container containing ink to be supplied to the print head.

According to the invention the moving speed of the print head is compared with the predetermined desired moving speed and the operating speed of the motor can be corrected for the next printing cycle on the basis of the result of the comparison.

When the moving speed of the print head changes, the operating speed of the motor, hence the traveling speed of the print head, for the next printing cycle can be corrected according to a change in the moving speed. Consequently, a minute change in the moving speed of the print head during each printing cycle can be corrected to adjust the moving speed to the desired moving speed. Therefore, the printing operation for each printing cycle can always be started from a fixed print starting position and hence print quality can be improved.

The next printing cycle is a printing cycle subsequent to the present printing cycle for printing print data provided by one scanning cycle.

According to the invention, the motor speed corrector may carry out a first correction operation to be executed while the print head travels the predetermined distance from the starting position and a second correction operation to be executed after the print head has traveled the predetermined distance in two separate stages.

Accuracy in correcting the operating speed of the motor when the first and the second correction operations are executed in two separate stages is higher than that when the operating speed of the motor is corrected once in each printing cycle.

For example, when a time in which the print head travels the predetermined distance from the starting position is an acceleration period in which the motor is accelerated, and a time after the print head has traveled the predetermined distance is a constant-speed period in which the motor operates at a fixed operating speed, the effect of the variation of the load on the motor in the constant-speed period is more significant than that of the same in the acceleration period in which the torque of the motor may be lower than that of the torque in the acceleration period. Therefore, it is desirable to use different control parameters in the acceleration period and the constant-speed period, respectively, and the operating speed of the motor can be controlled with high accuracy and the print quality can further be improved when the first and the second correction operations are executed in two stages using the different control parameters.

According to the invention, because the motor is a stepping motor controlled by a pulse signal, and the duty factor of the pulse signal is changed to correct the operating speed of the motor by the motor speed corrector, the moving speed of the print head can be adjusted to the desired moving speed by changing the duty factor to change the operating speed of the motor.

Incidentally, the print head is mounted on a carriage connected to a portion of an endless belt, and the endless belt is extended between a motor pulley mounted on the output shaft of the motor and an idler pulley, the motor pulls the carriage directly by the motor pulley in a forward printing cycle, and pulls the carriage via the idler pulley in a reverse printing cycle.

Therefore, the load acting on the motor through the motor pulley during the forward printing cycle and that acting on the motor through the motor pulley during the reverse printing cycle are different from each other. Hence, accurate feedback control of the operating speed of the motor cannot be achieved if the same control parameters are used for controlling the operating speed of the motor during the forward printing cycle and the reverse printing cycle.

According to the invention, the print head travels in the same direction for the next printing cycle, the operating speed of the motor can accurately be corrected by determining a correction according to the direction of movement of the print head.

The invention can very effectively be applied to a printer provided with an ink-jet print head which jets ink particles toward a recording medium.

As mentioned above, according to the invention, a correction for correcting the moving speed of the print head is determined on the basis of the moving speed in the preceding printing cycle, and the moving speed of the print head in the succeeding printing cycle is adjusted to the desired moving speed and, hence, the print head can be positioned with high accuracy at a print starting position and print quality can be improved.

BRIEF DESCRIPTION OF THE DRAWINGS

A preferred embodiment of the invention will be described in detail with reference to the accompanying drawings, wherein.

DETAILED DESCRIPTION OF THE PREFERRED EMBODIMENT

A preferred embodiment of the invention will be described with reference to the accompanying drawings.

A printer 10, in this embodiment, is an ink-jet printer (hereinafter referred to simply as "printer") which jets ink onto a recording medium using a print head for printing. The printer 10 is capable of printing in a resolution of 360 dpi (dots per inch) or 720 dpi.

Figure 1:
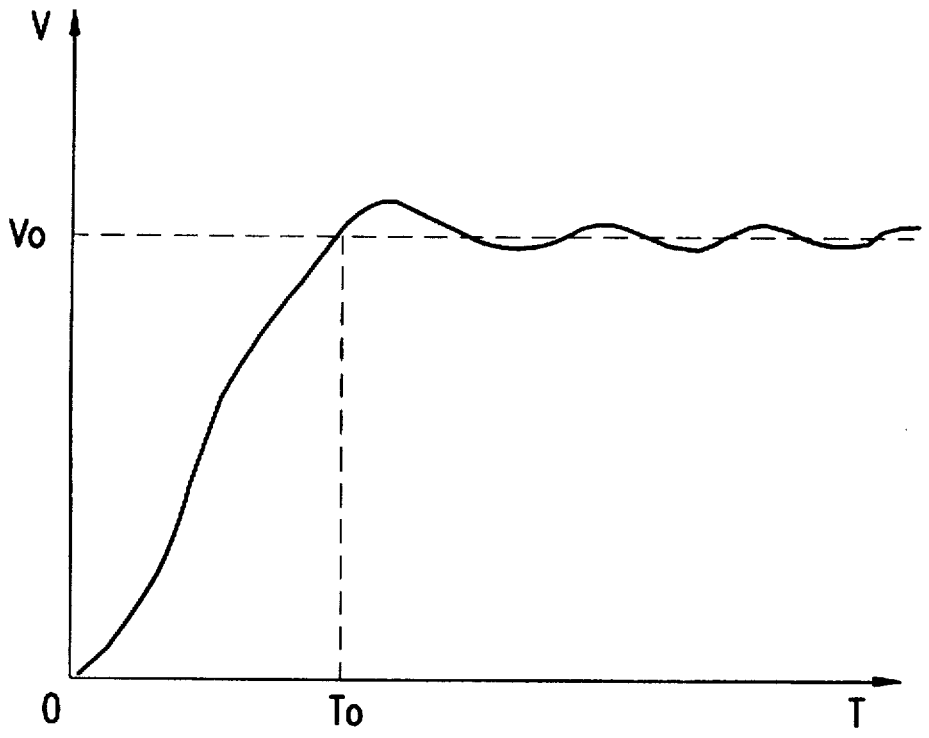
FIG. 1 RELATED ART
FIG. 1 is a graph showing the variation of the operating speed of a DC motor with time.
Figure 2:
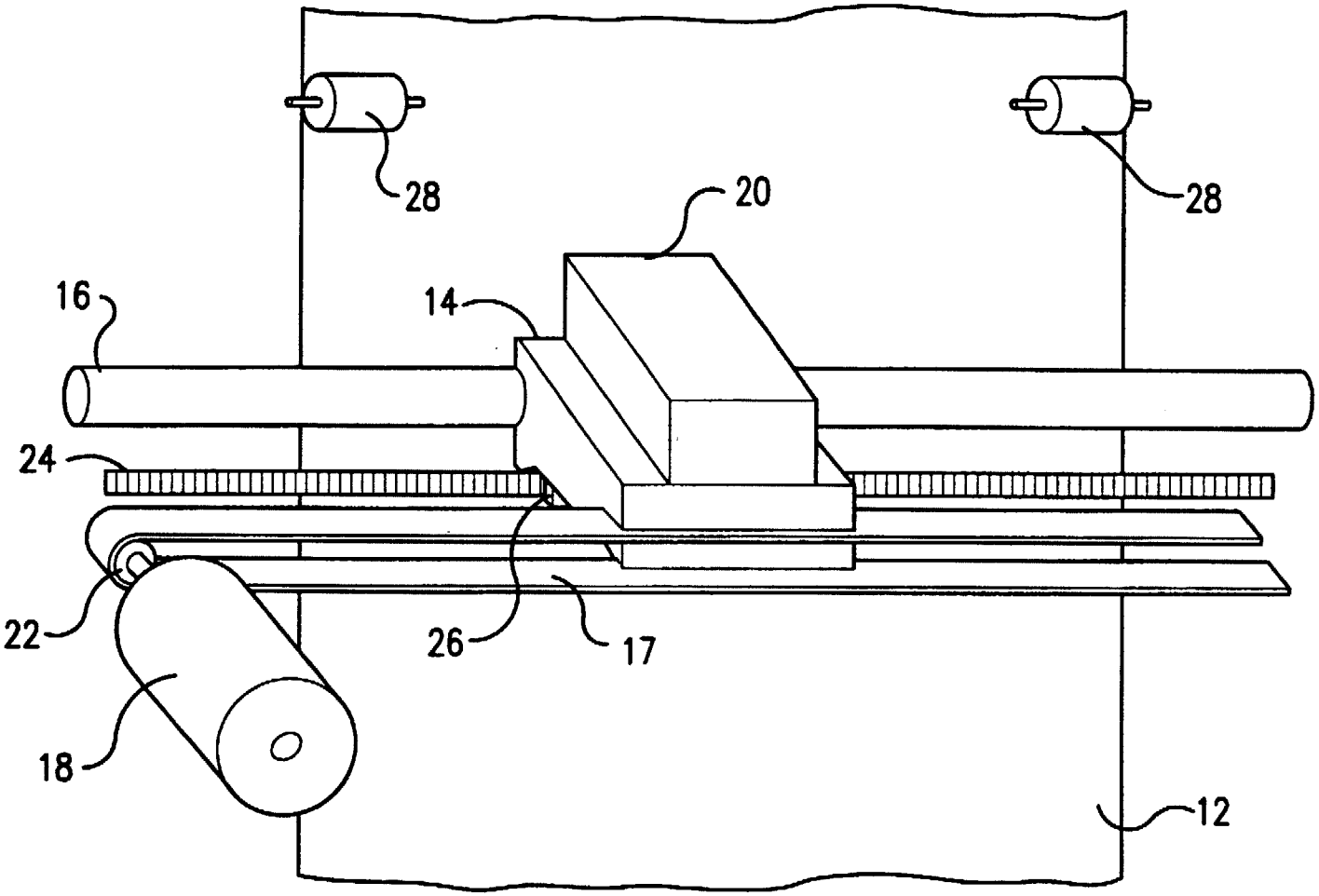
FIG. 2 is a perspective view of an internal mechanism included in a printer in a preferred embodiment according to the invention.
Figure 3:
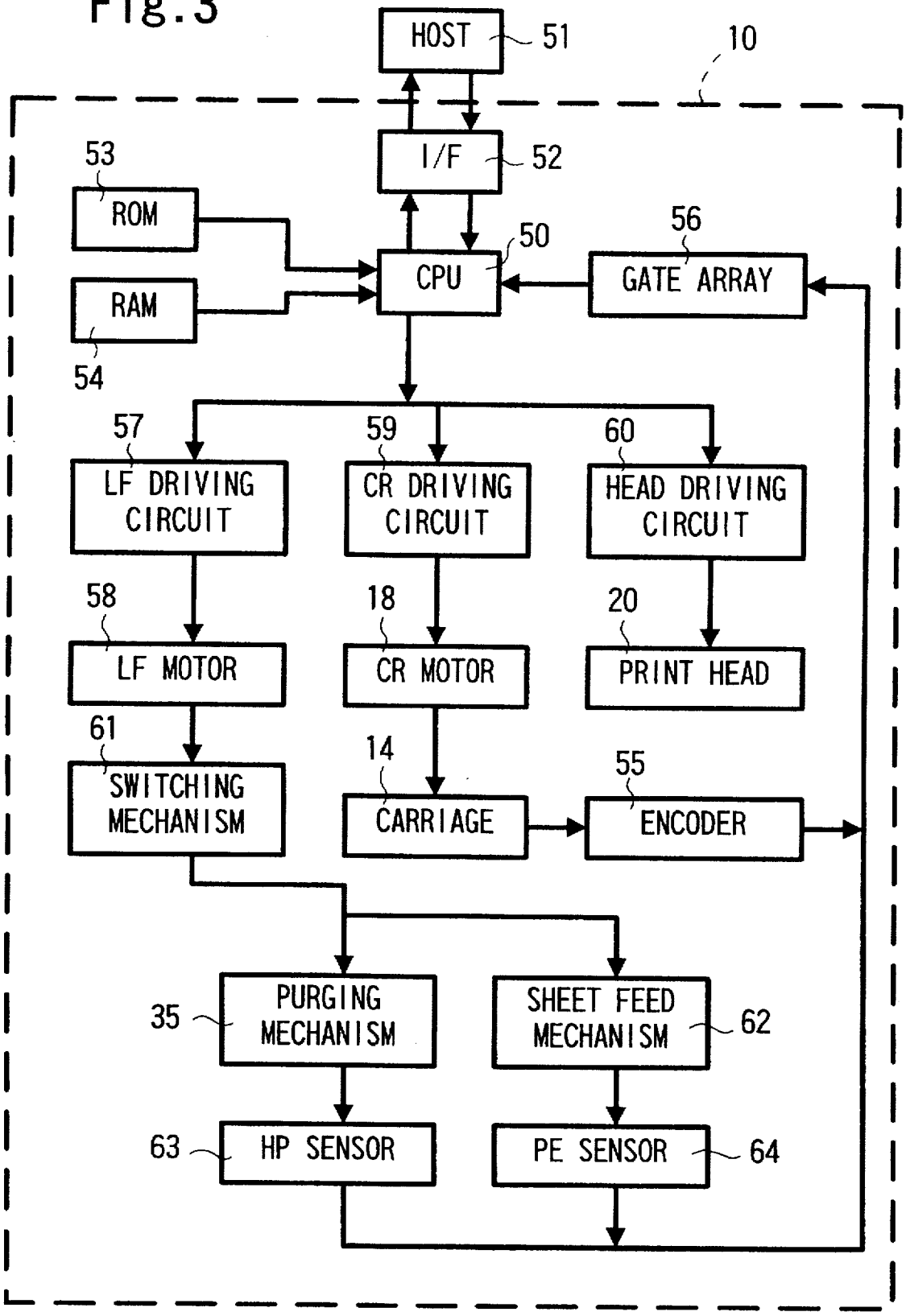
FIG. 3 is a block diagram of a control system included in the printer of FIG. 2.

FIG. 2 is a perspective view of an internal mechanism included in the printer 10 and FIG. 3 is a block diagram of a control system included in the printer 10 of FIG. 2.

The printer 10 is an ink-jet printer having a print head 20 having ink chambers respectively provided with piezoelectric elements. A voltage is applied to each piezoelectric element to change the volume of the corresponding ink chamber so that an ink particle is jetted through a nozzle onto a recording sheet 12, i.e., a recording medium, for printing.

The print head 20 is mounted on a carriage 14 slidably mounted on a guide shaft 16 extended along the width of the recording sheet 12.

The carriage 14 is attached to an endless belt 17 extended below and along the guide shaft 16. The endless belt 17 is extended between a pulley 22 mounted on the output shaft of a carriage motor (hereinafter referred to as "CR motor") 18 and an idler pulley, not shown. The CR motor 18 drives the carriage 14 through the endless belt 17 for reciprocation on the guide shaft 16 along the width of the recording sheet 12. A linear timing strip 24 made of a transparent material and provided with slits in a slit density of ninety slits per inch is extended under and in parallel to the guide shaft 16. A sensor 26 is attached to a lower portion of the front surface of the carriage 14. The sensor 26 counts the slits of the timing strip 24 and provides a pulse signal representing the position of the carriage 14.

Figure 4:
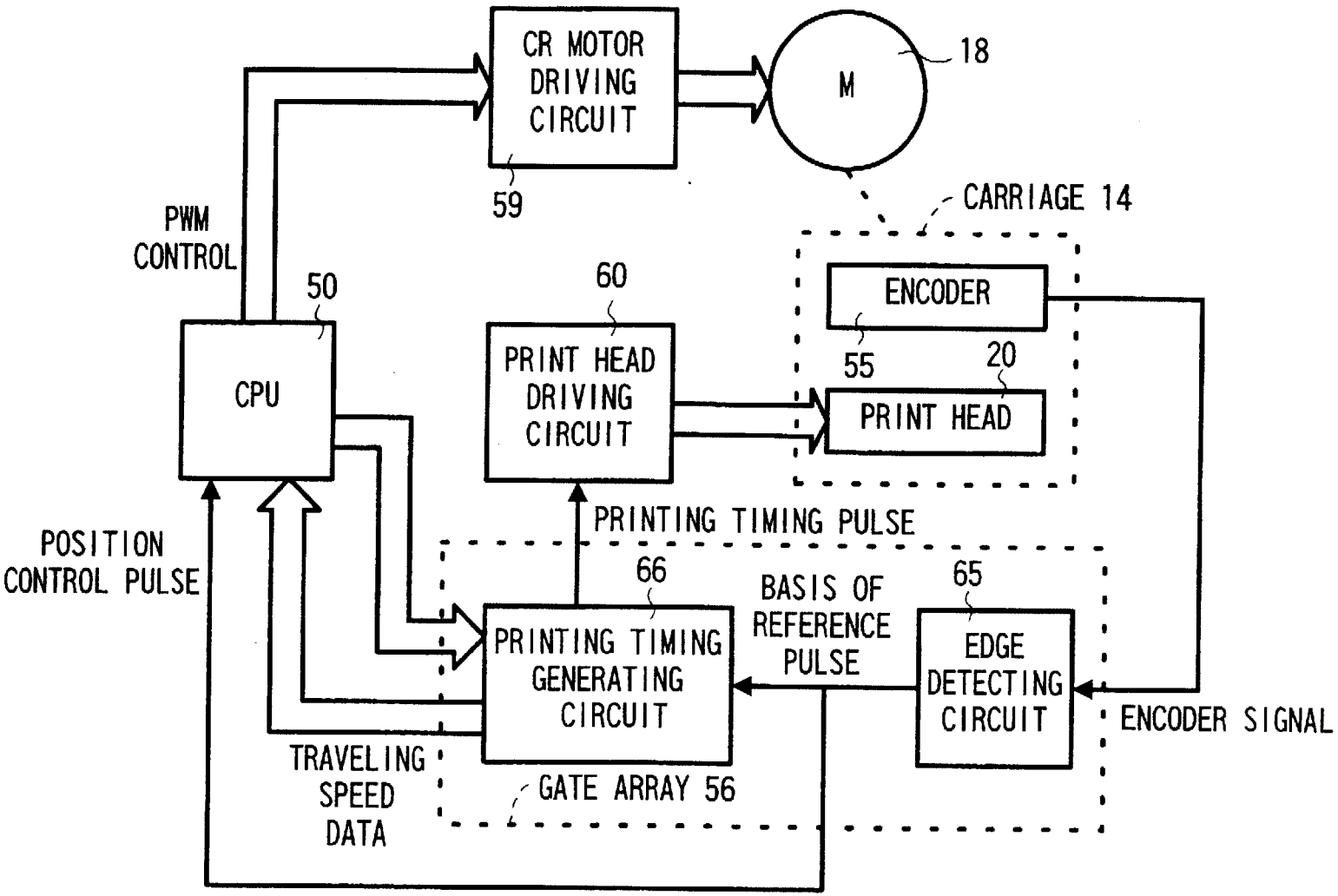
FIG. 4 is a block diagram of a gate array included in the control system of FIG. 3.

The sensor 26 has two photocouplers each consisting of a light emitting element and a light-sensitive element. The two photocouplers generate two pulse signals of the same frequency and with a phase difference of ¾ of a period. The traveling direction of the carriage is determined from the phase difference between the output pulse signals of the two photocouplers. The timing strip 24 and the sensor 26 constitute a linear encoder 55 (FIGS. 3 and 4).

The period of the pulse signals provided by the sensor 26 is dependent on the pitch of the slits of the timing strip 24 and the moving speed of the carriage 14.

The recording sheet 12 is held between a platen roller, not shown, and two pressure rollers 28 pressed against the platen roller, and the platen roller is driven for rotation to feed the recording sheet 12 in a vertical direction, as viewed in FIG. 2, by an LF motor 58 (FIG. 3) for driving the platen. The CR motor 18 is a DC motor, the operating speed of which is controlled in a PWM control mode, and the LF motor 58 is a stepping motor.

A principal portion of a control system included in the printer 10 will be described with reference to FIG. 3. The printer 10 is provided with a CPU 50 which performs various arithmetical operations. An interface 52 through which to receive signals representing print data and the like from a host computer 51, a ROM 53 storing programs and tables for mathematical operations, a RAM 54 for temporarily storing data, and a gate array 56 for counting the number of pulses of the output pulse signal of the sensor 26 and measuring the period of the output signal of the sensor 26 are connected to the CPU 50.

The tables stored in the ROM 53 include desired moving speed tables, each specifying a first desired moving speed $V_{01}$ at which the feedback control of the moving speed of the carriage 14 is started and a second desired moving speed $V_{02}$ for a state in which the carriage 14 travels at a substantially fixed moving speed after the traveling speed of the carriage 14 has reached the first desired moving speed $V_{01}$, rise distance allowance tables (hereinafter referred to simply as "distance tables") each specifying a minimum allowable value and a maximum allowable value for a desired rise distance for which the carriage 14 travels before its moving speed reaches the first desired moving speed $V_{01}$, desired moving speed allowance tables (hereinafter referred to simply as "speed tables") each specifying an allowance for the second desired traveling speed $V_{02}$ for the state in which the carriage 14 moves at a substantially fixed moving speed after the moving speed of the carriage 14 has reached the first desired moving speed $V_{01}$ at which the feedback control of the moving speed of the carriage 14 is started, and correction tables each specifying a correction for correcting the duty factor of a PWM signal to be applied to the CR motor 18.

The tables are prepared for a forward printing mode in a resolution of 360 dpi, a forward printing mode in a resolution of 720 dpi, a reverse printing mode in a resolution of 360 dpi and a reverse printing mode in a resolution of 720 dpi, respectively.

The CPU 50 stores print data received through the interface 52 from the host computer 51 in a predetermined buffer area in the RAM 54, and performs arithmetical control operations for producing control signals necessary for driving the LF motor 58 and the CR motor 18 and an editing operation for editing data for driving the print head 20 according to a printing program stored beforehand in the ROM 53. An LF motor control signal for controlling the LF motor 58 is given to an LF driving circuit 57. Then, the LF motor 58 is driven by an LF motor driving signal provided by the LF driving circuit 57 to feed the recording sheet 12.

A CR motor control signal for controlling the CR motor 18 is given to a carriage driving circuit (hereinafter referred to as "CR driving circuit") 59. Then, the CR motor 18 is driven by a CR motor driving signal (PWM signal) provided by the CR driving circuit 59 to drive the carriage 14 for reciprocating motion. The position of the carriage 14 is detected by the linear encoder 55. A pulse signal provided by the linear encoder 55 is applied to the gate array 56, and then the CPU 50 executes operations including a correction calculating operation.

The CPU 50 reads the printing data from the RAM 54 at a predetermined time while the carriage 14 is moving and gives the printing data to a print head driving circuit 60. Then, the print head driving circuit 60 provides a print head driving signal to drive the print head 20.

When the print head driving signal is given to the print head 20, a voltage is applied to the piezoelectric elements of the printing elements of the print head 20, vibrating plates disposed in ink chambers corresponding to the energized piezoelectric elements are displaced to pressurize the ink contained in the ink chambers so that ink particles are jetted from the ink chambers.

The CPU 50 counts the number of pulses of the LF motor driving signal to determine the distance of feed of the recording sheet 12 fed through a sheet feed mechanism 62 by the LF motor 58 and the angle of rotation of a cam for driving a purging mechanism 35 for purging the print head 20 of ink clogging the nozzles. The purging mechanism 35 is provided with a home position sensor (HP sensor) 63 for detecting the carriage 14 at a home position, and the sheet feed mechanism 62 is provided with a paper empty sensor (PE sensor) 64 for detecting the presence of a recording sheet 12 in the printer 10.

The gate array 56 will be described with reference to FIG. 4 showing, in a block diagram, the gate array 56 included in the control system shown of FIG. 3. The gate array 56 comprises an edge detecting circuit 65 which detects the leading edge of an encoder signal provided by the linear encoder 56 and generates a reference pulse upon detection of the leading edge of a pulse of the encoder signal, and a printing timing signal generating circuit 66 which generates printing speed data calculated from the pulse period of the encoder signal, i.e., the interval between the leading edges of pulses of the encoder signal, and generates the printing timing signal for driving the print head on the basis of the reference pulse signal provided by the edge detecting circuit 65.

The CPU 50 receives the printing speed data (data representing time intervals between the leading edges of the encoder signal) from the printing timing signal generating circuit 66, carries out a feedback PWM control operation and performs a correction calculating operation for calculating a correction for correcting the pulse width of the CR motor driving signal for driving the CR motor 18 to provide a PWM signal for the next speed control cycle. The CPU 50 receives the position control pulse signal (reference pulse signal) for position control provided by the edge detecting circuit 65 and calculates the present position of the carriage 14. The CPU 50 writes a delay count for correcting the dislocation of a printing position when the printing direction is reversed and data for enabling a print start signal in a predetermined register including the gate array 56.

A moving speed control operation, particularly, a correction calculating operation for PWM control, to be performed by the CPU 50, will be described with reference to FIGS. 5 to 10.

In this embodiment, the distance D1 between a movement starting position and a feedback control starting position where a feedback control operation is started, i.e., a position where the moving speed of the carriage 14 reaches the first desired moving speed $V_{01}$, data representing a maximum moving speed $V_{MAX}$ in an acceleration period and data representing a maximum moving speed $V_{2MAX}$ and a minimum moving speed $V_{2MIN}$ in a constant-speed period in which the feedback control operation is executed either when the carriage 14 is moving forward or when the carriage 14 is moving in reverse are stored in a predetermined register included in the gate array 56 or in a predetermined storage area in the CPU 50 or the RAM 54. When the carriage 14 is stopped, a query is made to see if a PWM value $\alpha$ (a value indicating the duty factor of the PWM signal, i.e., the ratio of on-time to a fixed period) in the acceleration period and a PWM value $\beta$ in the constant-speed period in the present printing cycle are appropriate values. When necessary, the PWM values are corrected, and the movement of the carriage 14 in the same moving direction in the next printing cycle is controlled on the basis of the corrected PWM values.

Thus, the correction operation is performed in both the acceleration period from the time when the carriage 14 starts moving to the time when the constant-speeds, travel starts, and during the constant-speed period. The feedback PWM control is not executed in the acceleration period because the feedback PWM control in the acceleration period requires complicated control procedures and increases the load on the CPU 50.

Figure 5:
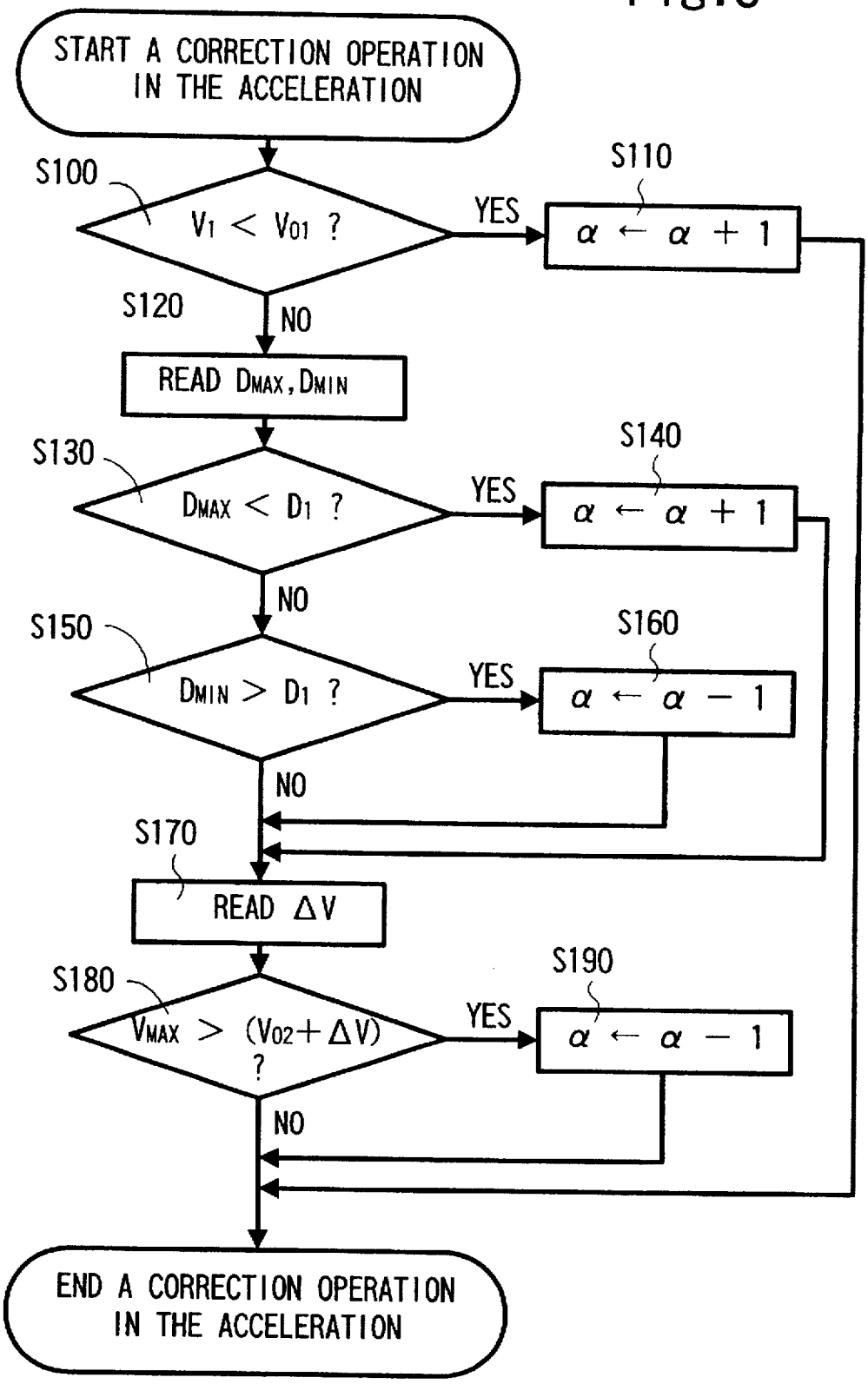
FIG. 5 is a flow chart of a correction operation in an acceleration period.
Figure 6:
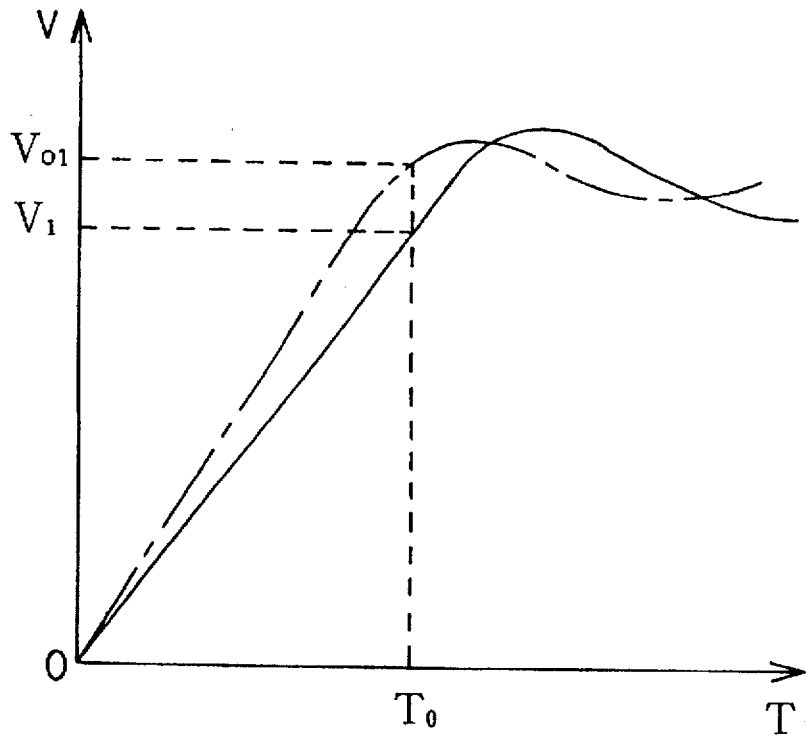
FIG. 6 is a graph of assistance in explaining the correction operation in the acceleration period.
Figure 7:
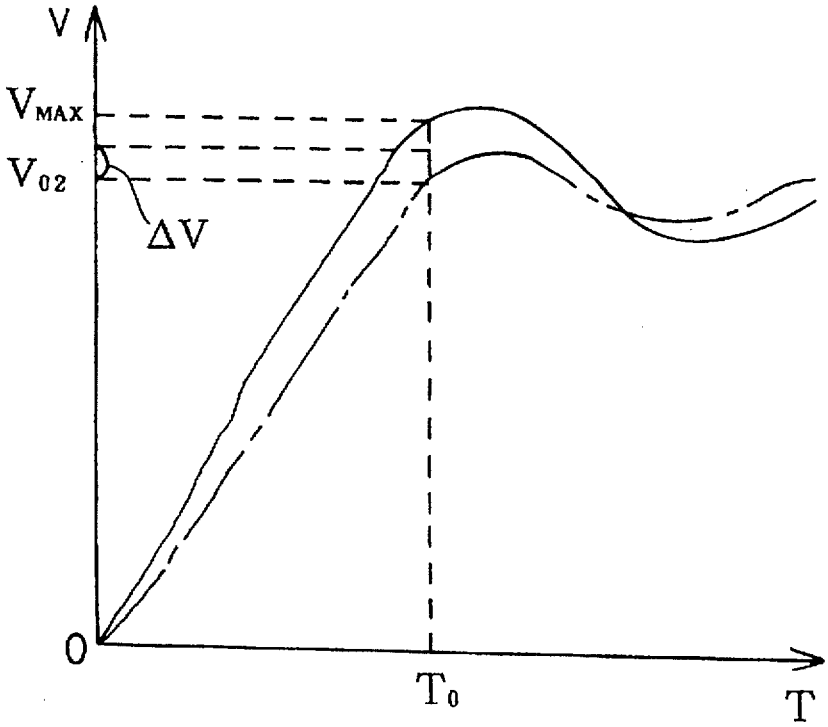
FIG. 7 is a graph of assistance in explaining the correction operation in the acceleration period.

FIG. 5 is a flowchart showing steps of the correction operation in the acceleration period and FIGS. 6 and 7 are graphs of assistance in explaining the correction operation in the acceleration period.

The carriage 14 is started from the movement starting position. In step S100, a query is made to see if the moving speed $V_1$ of the carriage 14 at a position at the desired rise distance (for example, 30 mm) from the starting position is lower than the first desired moving speed $V_{01}$ for starting the feedback PWM control operation. The first desired moving speed $V_{01}$ is read from the desired moving speed table stored in the ROM 53. When $V_1<V_{01}$, as shown in FIG. 6, it is expected that the moving speed $V_1$ of the carriage 14 does not increase to the first desired moving speed $V_{01}$ in the next printing cycle when the carriage 14 travels in the same direction if the moving speed of the carriage 14 is not corrected. Therefore, the PWM value a for the acceleration period is incremented by 1 in step S110 to use an increased PWM value $\alpha+1$ in the acceleration period in the next printing cycle in which the carriage 14 travels in the same direction so that the acceleration of the CR motor 18 is enhanced.

Since it is an essential condition for the feedback PWM control that the moving speed of the carriage 14 must increase at least to the first desired traveling speed $V_{01}$ before the carriage 14 reaches the print starting position, a correction is made in the next printing cycle so that the condition is satisfied. For example, when the present duty factor is 30%, the PWM value (the ratio of on-time to the period of the pulse signal) is incremented by one to increase the duty factor to 31%. Consequently, the acceleration of the CR motor 18 is increased for the next printing cycle and the moving speed of the carriage 14 in the next printing cycle can be increased to the first desired moving speed $V_{01}$ before the carriage 14 reaches the print starting position.

When it is decided in step S100 that $V_1 \geqq V_{01}$, queries are made in step S120 and the following steps to see if the distance D1 from the movement starting position to a position where the moving speed reached the first desired moving speed $V_{01}$ and the feedback control is started is within a predetermined range of, for example, 23 mm to 28 mm. If the carriage 14 is accelerated excessively and the moving speed reaches the first desired moving speed $V_{01}$ in an excessively short distance, the moving speed of the carriage 14 overshoots in the constant-speed period and a satisfactory feedback control of the moving speed is impossible. Therefore, it is necessary to see if the carriage 14 has properly been accelerated.

In step S120, a maximum allowable distance $D_{MAX}$ and a minimum allowable distance $D_{MIN}$ for the moving speed of the carriage 14, which is dependent on a desired resolution, and the direction of movement are read from the distance table stored in the ROM 53.

Subsequently, the distance $D_1$ is compared with the maximum allowable distance $D_{MAX}$ (for example, 28 mm) in step S130. When $D_1>D_{MAX}$ (the response in step S130 is YES), i.e., when the carriage 14 needs to travel a distance longer than the maximum allowable distance $D_{MAX}$ before the moving speed reaches the first desired moving speed $V_{01}$, the acceleration of the carriage 14 for the next printing cycle must be increased to diminish the distance $D_1$. Therefore, the PWM value $\alpha$ is increased to a PWM value $\alpha+1$ in step S140 to increase the acceleration of the CR motor 18 for the next printing cycle.

When it is decided that $D_1<D_{MAX}$ in step S130, i.e., when the response in step S130 is NO, a query is made in step S150 to see if the distance $D_1$ is shorter than the minimum allowable distance $D_{MIN}$. When $D_1<D_{MIN}$, i.e., when the response in step S150 is YES, the moving speed of the carriage 14 reached the first desired moving speed $V_{01}$ when the carriage 14 traveled a distance shorter than the minimum allowable distance $D_{MIN}$. Therefore, the PWM value $\alpha$ for the acceleration period is decremented by 1 in step S160; that is, the duty factor is decreased to reduce the acceleration of the CR motor 18.

When the moving speed of the carriage 14 in the acceleration period reaches the first desired moving speed $V_{01}$ before the carriage 14 travels the desired rise distance of 30 mm, regardless of whether the distance $D_1$ traveled by the carriage before the distance travelled reached the first desired moving speed $V_0$l is shorter than the maximum allowable distance $D_{MAX}$ or whether the distance $D_1$ traveled by the carriage before the distance travelled reached the first desired moving speed $V_{01}$ is longer than the minimum allowable distance $D_{MIN}$, step S170 and the following steps are executed for a further accurate control operation, i.e., a control operation capable of preventing overshooting.

In step S170, a desired moving speed allowance $\Delta V$ for the present moving speed and the movement direction of the carriage 14 is read from the moving speed table stored in the ROM 53, and a query is made in step S180 to see if the maximum moving speed $V_{MAX}$ in the acceleration period in the present printing cycle is higher than a maximum allowable moving speed $V_{PMAX}$ equal to the sum of the second desired moving speed $V_{02}$ and the desired moving speed allowance $\Delta V$. The second desired moving speed $V_{02}$ is read from the desired moving speed table stored in the ROM 53.

If $V_{MAX}>V_{02}+\Delta V$, as shown in FIG. 7, the PWM value $\alpha$ is decremented by 1 in step S190 to reduce the operating speed of the CR motor 18 so that overshooting may not occur.

If the moving speed in the acceleration period has a high tendency to overshoot, there is the possibility that the moving speed overshoots and fluctuates in the constant-speed period subsequent to the acceleration period, thereby causing irregular ink jetting operation of the print head. Therefore, the PWM value $\alpha$ is adjusted to prevent the overshoot of the moving speed and the resultant irregular ink jetting operation of the print head.

Optimum corrections to be used in the foregoing steps for correcting the PWM value $\alpha$ are determined beforehand through experiments and listed in correction tables for moving speeds of the carriage 14 for resolutions stored in the ROM 53. The desired moving speed allowance $\Delta V$ to be used in step S170 is calculated by multiplying the second desired moving speed $V_{02}$ by a predetermined constant. For example, the constant for the resolution of 360 dpi is 5% and 3% is used for the resolution of 720 dpi.

Printing an image in a higher resolution requires a higher accuracy in positioning the carriage 14 at the printing position.

The calculations in steps S120 to S160 use parameters relating to distance, however, the calculations may use parameters relating to speed.

Figure 8:
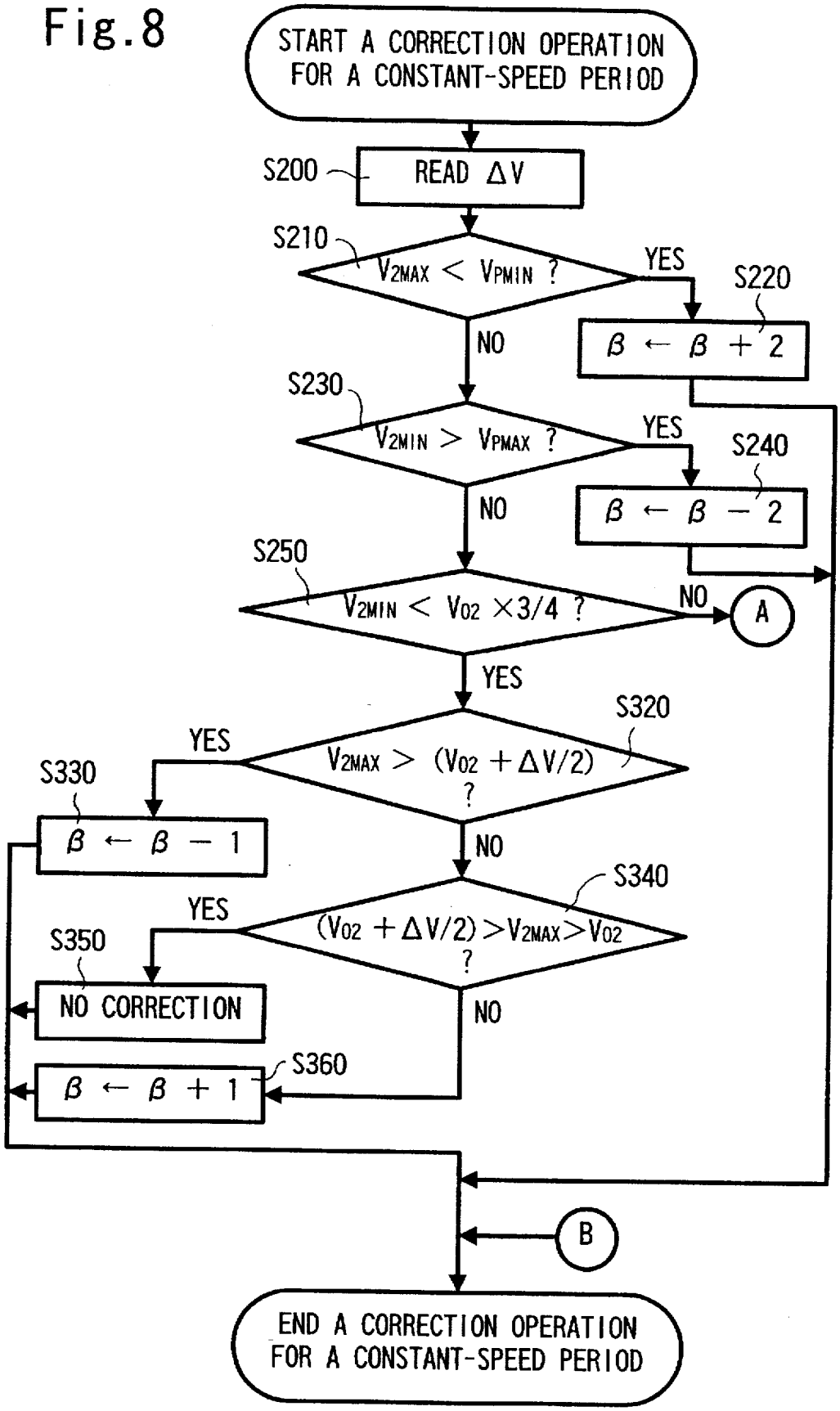
FIG. 8 is a flow chart of a correction operation for a constant-speed period.
Figure 9:
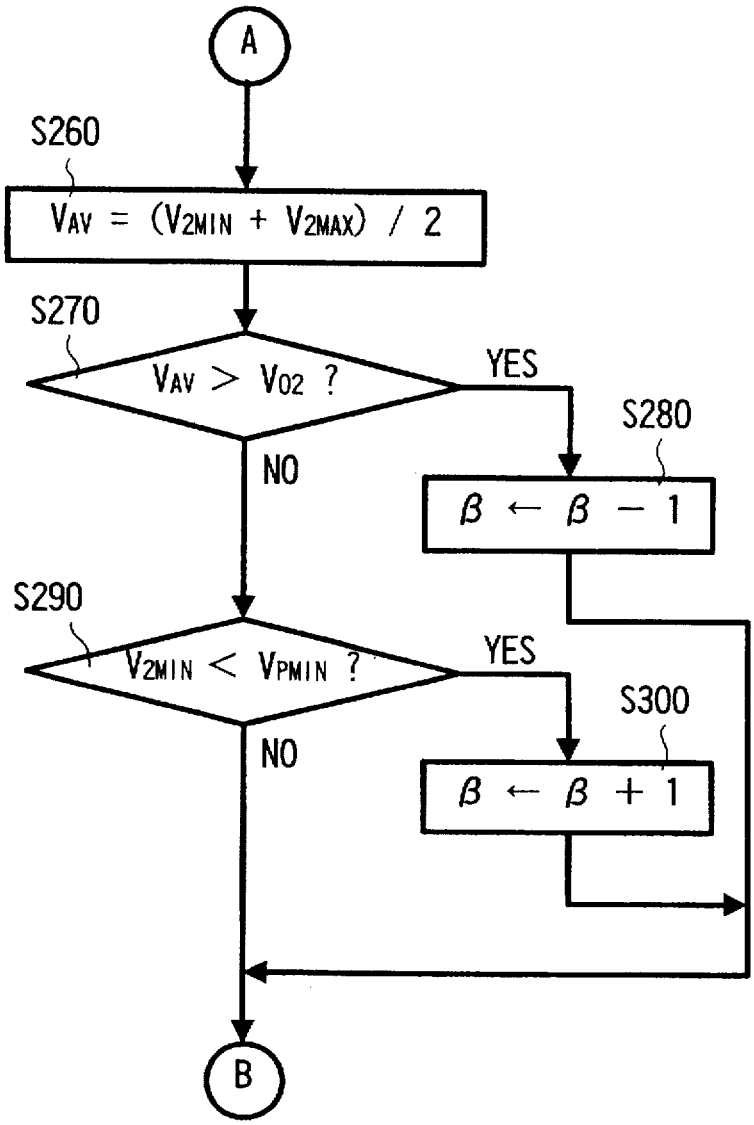
FIG. 9 is a flow chart of a procedure branched from the flow char of FIG. 8.
Figure 10:
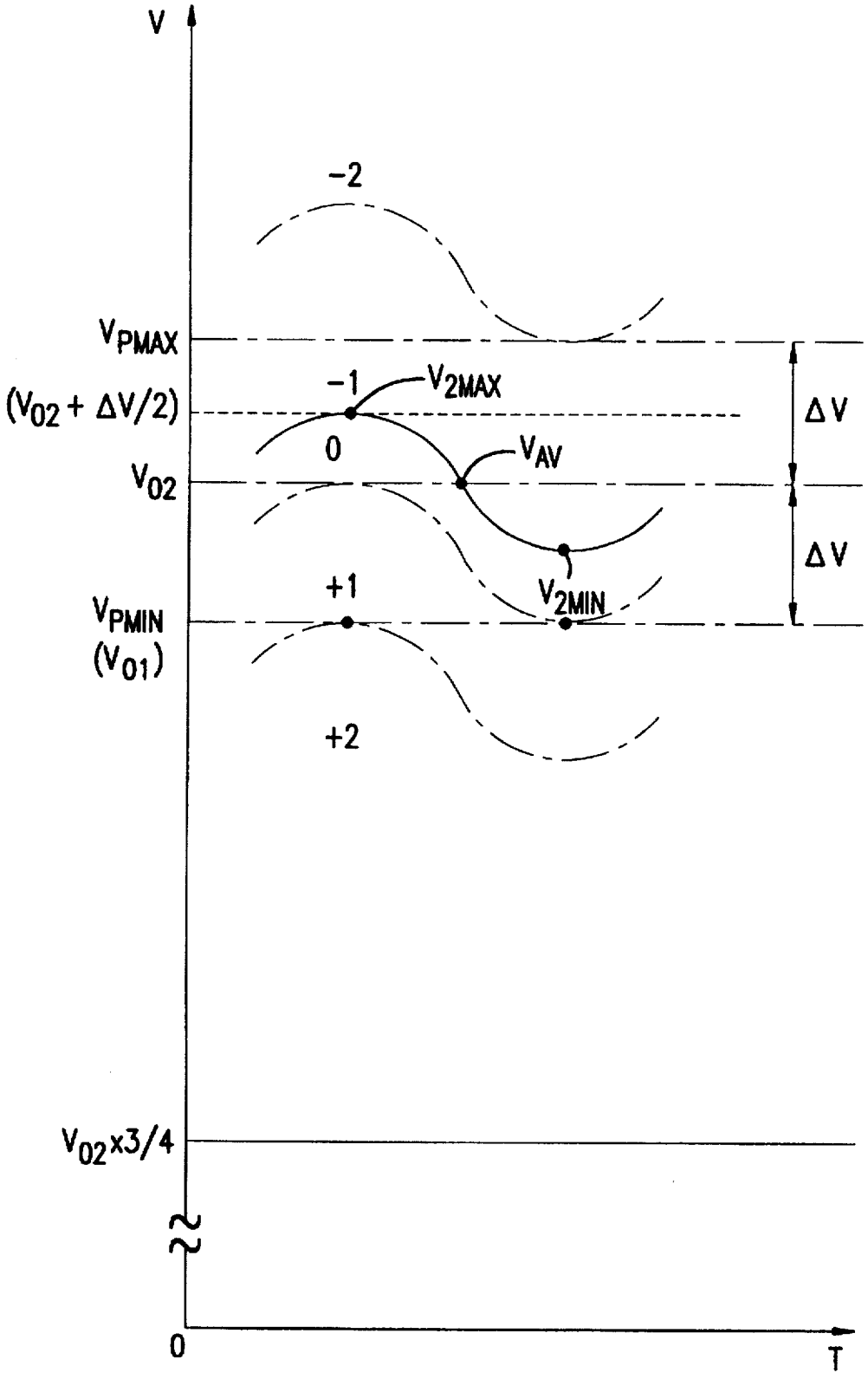
FIG. 10 is a graph of assistance in explaining the effect of correction in the constant-speed period.

A correction operation in the constant-speed period will be described with reference to FIGS. 8 to 10. FIGS. 8 and 9 are flowcharts of a correction operation for a constant-speed period and FIG. 10 is a graph of assistance in explaining the effect of correction in the constant-speed period.

First, a desired moving speed allowance $\Delta V$ for the moving speed and the direction of movement in the present constant-speed period is read from the moving speed table in step S200, and then a query is made in step S210 to see if a maximum moving speed $V_{2MAX}$ in the present constant-speed period is lower than an allowable minimum moving speed $V_{PMIN}$, i.e., the remainder of subtraction of the desired moving speed allowance $\Delta V$ from the second desired moving speed $V_{02}$. If $V_{2MAX}<V_{PMIN}$, i.e., if the moving speed of the carriage 14 is far lower than the second desired moving speed $V_{02}$, the PWM value $\beta$ of the pulse signal supplied to the CR motor 18 in the constant-speed period is incremented by 2, in step S220, to use a PWM value $\beta+2$ when the carriage 14 travels in the same direction in the next constant-speed period.

That is, the operating speed of the CR motor 18 is increased so that the moving speed of the carriage 14 approaches the second desired moving speed $V_{02}$ to prevent the dislocation of the carriage 14 from the printing position.

If $V_{2MAX}\geqq V_{PMIN}$, it is considered that the moving speed of the carriage 14 is not excessively low, and a query is made in step S230 to see if the minimum moving speed $V_{2MIN}$ in the present constant-speed period is lower than the allowable maximum moving speed $V_{PMAX}$, i.e., the sum of the second desired moving speed $V_{02}$ and the desired moving speed allowance $\Delta V$. If $V_{2MIN}>V_{PMAX}$, i.e., if the moving speed of the carriage 14 is considerably higher than the second desired moving speed $V_{02}$, the PWM value $\beta$ of the pulse signal supplied to the CR motor 18 in the constant-speed period is decremented by 2 in step S240.

That is, the rotating speed of the CR motor 18 is reduced so that the traveling speed approaches the second desired traveling speed $V_{02}$ to prevent the dislocation of the carriage 14 from the printing position.

When the maximum moving speed $V_{2MAX}$ in the present constant-speed is within an allowable range, steps S250 and the following steps are executed for a further accurate correction.

In step S250, a query is made to see if the minimum moving speed $V_{2MIN}$ in the present constant-speed period is lower than ¾ of the second desired moving speed $V_{02}$, and one of two subsequent procedures is carried out depending on the determination made in step S250. If $V_{2MIN}<\frac{3}{4}\times V_{02}$, i.e., the response in step S250 is YES, the measured minimum moving speed $V_{2MIN}$ is considered to be unreliable (correct correction cannot be achieved even if a correction operation is performed on the basis of the unreliable value), and steps S320 and the following steps shown in FIG. 8 are executed.

The unreliable measurement of the minimum moving speed $V_{2MIN}$ is possible when the timing strip 24 is contaminated with dust and the sensor 26 is unable to detect the slits accurately. In such a case, a moving speed determined from the period of pulses of the encoder signal is half the actual moving speed when one pulse signal is missed. Therefore, it is possible to determine whether the data representing the measured moving speed is erroneous through the examination of the moving speed using ¾ of the second desired moving speed $V_{02}$ as a threshold.

When the response in step S250 is Yes, i.e., when it is decided that the measured minimum moving speed $V_{2MIN}$ is unreliable, steps S320 and the following steps are executed to carry out a correction operation without using the minimum moving speed $V_{2MIN}$.

In step S320, a query is made to see if the measured maximum moving speed $V_{2MAX}$ is higher than the sum of the second desired moving speed $V_{02}$ and ½ of the desired moving allowance $\Delta V$, i.e., a moving speed between the second desired moving speed $V_{02}$ and the maximum allowable moving speed $V_{PMAX}$ (hereinafter referred to as "approximate desired moving speed") to see how the maximum moving speed $V_{2MAX}$ is close to the desired moving speed $V_{02}$.

If the maximum moving speed $V_{2MAX}$ is higher than the approximate desired moving speed, i.e., if the response in step S320 is Yes, the PWM value $\beta$ for the constant-speed period is decremented by 1 in step S330 to reduce the operating speed of the CR motor 18 in the next constant-speed period when the carriage 14 travels in the same direction. If the maximum moving speed $V_{2MAX}$ is equal to or below the approximate desired moving speed, i.e., if the response in step S320 is No, step S340 is executed to see if the maximum moving speed $V_{2MAX}$ is lower than the approximate desired moving speed $V_{02}+\Delta V/2$ and higher than the second desired moving speed $V_{02}$.

If the maximum moving speed $V_{2MAX}$ is lower than the approximate desired moving speed $V_{02}+\Delta V/2$ and higher than the second desired moving speed $V_{02}$, i.e., the response in step S340 is affirmative, no correction operation is performed in step S350. If the maximum moving speed $V_{2MAX}$ is equal to or lower than the second desired moving speed $V_{02}$, i.e., the response in step S340 is no, the PWM value $\beta$ for the constant-speed period is incremented by 1 in step S360.

On the other hand, if the minimum moving speed $V_{2MIN}$ is greater than or equal to ¾ of the second desired moving speed $V_{02}$, i.e., if the response in step S250 is no, step S260 is executed to calculate new moving speed data using the minimum moving speed $V_{2MIN}$, which is considered to be reliable because there is no missing pulse in the encoder signal. In step S260, an average moving speed $V_{AV}$ as new moving speed data for the correction operation, i.e., the average of the minimum moving speed $V_{2MIN}$ and the maximum moving speed $V_{2MAX}$, is calculated. The average moving speed $V_{AV}$ is used as a reference value for the correction operation.

Subsequently, a query is made in step S270 to see if the average moving speed $V_{AV}$ is higher than the second desired moving speed $V_{02}$. If the average traveling speed $V_{AV}$ is higher than the second desired traveling speed $V_{02}$, i.e., if the response in step S270 is YES, the PWM value β for the constant-speed period is decremented by 1 in step S280 to reduce the operating speed of the CR motor 18 for the next constant-speed period when the carriage 14 travels in the same direction. If the average moving speed $V_{AV}$ is not higher than the second desired moving speed $V_{02}$, i.e., if the response in step S270 is NO, step S290 is executed to see if the minimum moving speed $V_{2MIN}$ is lower than the minimum allowable moving speed $V_{PMIN}$. If the minimum moving speed $V_{2MIN}$ is lower than the minimum allowable moving speed $V_{PMIN}$, i.e., if the response in step S290 is YES, the PWM value β for the constant-speed period is incremented by 1 in step S300 to increase the rotating speed of the CR motor 18 for the next constant-speed period when the carriage 14 travels in the same direction.

When the minimum moving speed $V_{2MIN}$ is not lower than the minimum allowable moving speed $V_{PMIN}$, i.e., the response in step S290 is NO, the PWM value β need not be corrected, the PWM value β for the present constant-speed period is used for the next constant-speed period when the carriage 14 travels in the same direction.

As is apparent from the foregoing description, in the printer in this embodiment, a change in the moving speed of the carriage in the present printing cycle is reflected in the mode of movement of the carriage in the next printing cycle when the carriage travels in the same direction, so that the moving speed of the carriage can quickly be corrected.

Since the moving speed of the carriage is corrected every printing cycle so that the moving speed approaches the desired moving speed, the carriage can be positioned at the printing position with high accuracy. Particularly, even the moving speed of the carriage of an ink-jet printer, which varies due to the variation of the mass of the carriage with the repetition of the ink jetting operation, can be corrected by the repetitive correcting operation and hence print quality can be improved.

Although the foregoing embodiment uses the minimum allowable moving speed $V_{PMIN}$, i.e., a moving speed lower than the second desired moving speed $V_{02}$ for the feedback control by the desired moving speed allowance ΔV, as the first desired moving speed $V_{01}$ at which the feedback control is started in the acceleration period, the second desired moving speed $V_{02}$ for feedback control may be used as the first desired traveling speed $V_{01}$.

The encoder 55, the gate array 56, the CPU 50 and the CR control circuit 59 correspond to a moving speed detecting means and a motor control means of the invention, steps S100 to S190 and S200 to S360 correspond to a correcting means, steps S100 to S190 correspond to a first correcting means, and steps S200 and S360 correspond to a second correcting means.

The invention is not limited in its practical application to the preferred embodiment specifically described herein, but is applicable to wire dot printers, thermal printers and such.

What is claimed is:

1. A printer, comprising:

a print head that moves along a recording medium to print images on the recording medium;

a motor for driving the print head for movement;

a motor control means for controlling an operating speed of the motor during an acceleration phase and a printing phase of a printing cycle;

moving speed detecting means for detecting a moving speed of the print head during each phase; and motor speed correcting means which for comparing the moving speed of the print head detected by the moving speed detecting means with a predetermined desired moving speed during the acceleration phase, and for directing the motor speed correcting means to correct the operating speed of the motor in a present printing cycle on the basis of a result of the comparison to provide a desired operating speed to which the motor control means adjusts the operating speed of the motor in a next printing cycle.

2. The printer according to claim 1, wherein the motor speed correcting means includes a first motor speed correcting means which compares a maximum moving speed of the print head during movement for a predetermined distance from a starting position with a predetermined first desired moving speed and corrects the operating speed of the motor on the basis of the result of comparison to provide an operating speed at which the motor is to operate during movement of the print head for the predetermined distance from the starting position in the next printing cycle.

3. The printer according to claim 2, where in the motor speed correcting means includes a second motor speed correcting means which compares the moving speed of the print head after the print head has moved the predetermined distance, and entered the printing phase, with a predetermined second desired moving speed and corrects the operating speed of the motor to provide a desired operating speed at which the motor is to operate during the movement of the print head after the print head has traveled the predetermined distance in the next printing cycle.

4. The printer according to claim 1, wherein the motor speed correcting means change the duty factor of the pulse signal to correct the operating speed of the motor.

5. The printer according to claim 1, wherein the print head moves in the succeeding printing cycle in the same direction as that in which the print head moved in the preceding printing cycle.

6. The printer according to claim 1, wherein the print head is an ink-jet print head for jetting ink particles onto a recording medium and provided with an ink cartridge containing ink to be supplied to the print head.

7. The printer according claim 3, wherein the correcting means changes the duty factor of the pulse signal when correcting the operating speed of the motor.

8. The printer according to claim 7, further comprising a first desired moving speed storage means and a second desired moving speed storage means.

9. The printer according to claim 8, further comprising a minimum allowable distance storage means and a maximum allowable distance storage means.

10. The printer according to claim 9, wherein the first motor speed correcting means compares a distance moved by the print head before the moving speed reached the first desired moving speed with the minimum allowable distance stored in the minimum allowable distance storage means and the maximum allowable distance stored in the maximum allowable distance storage means, and executes a correction procedure on the basis of the result of comparison.

11. The printer according to claim 8, further comprising a desired moving speed allowance storage means storing an allowance for the first desired moving speed.

12. A printer according to claim 11, wherein the second correcting means executes a correction procedure on the basis of the second desired moving speed, and the desired moving speed allowance stored in the desired moving speed allowance storage means.

13. The printer according to claim 12, wherein the second correcting means examines a minimum moving speed detected by the moving speed detecting means to see if the minimum moving speed is reliable, and executes a correction procedure on the basis of the examination.

14. A method of obtaining an optimal printing speed for a print head of a printer for each direction of movement across a print page for both an acceleration phase and a print phase of a print cycle, comprising the steps of:

determining whether the print head is in the acceleration phase or the print phase; and, when in the acceleration phase, determining a moving speed of the print head; and comparing the moving speed with a first desired moving speed and when the moving speed is less than the first desired moving speed, increasing a pulse width of a signal, applied to a drive motor for moving the print head, by an increment for use in a next print cycle when the print head travels in a same direction to increase the moving speed.

15. The method according to claim 14, when the moving speed is greater than or equal to the first desired moving speed, further comprising the steps of:

determining a distance moved when the print head reached the first desired moving speed;

comparing the distance moved to a predetermined maximum allowable distance and a predetermined minimum allowable distance;

increasing the pulse width by the increment when the predetermined maximum allowable distance is less than the distance moved and incrementally decreasing the pulse width when the predetermined minimum allowable distance is greater than the distance moved;

comparing a predetermined maximum allowable moving speed with a maximum moving speed of the print head during the acceleration phase; and reducing the pulse width by the increment when the maximum moving speed is greater than the predetermined maximum allowable moving speed to decrease the moving speed.

16. The method according to claim 15, wherein the increment is one unit.

17. The method according to claim 14, when the print head is in the print phase, further comprising the steps of:

determining a maximum moving speed and a minimum moving speed of the print head; and comparing a maximum moving speed with an allowable minimum moving speed and when the maximum moving speed is less than the allowable minimum moving speed, increasing a pulse width of a signal applied to the drive motor by a second increment.

18. The method according to claim 17, wherein when the maximum moving speed is greater than or equal to the allowable minimum moving speed, comprising the steps of:

comparing the minimum moving speed with an allowable maximum moving speed; and, when the minimum moving speed is greater than the allowable maximum moving speed, decrementing the pulse width by the second increment.

19. The method according to claim 18, wherein when the minimum moving speed is less than or equal to the maximum allowable moving speed, further comprising the steps of:

comparing the minimum moving speed to a predetermined proportion of a second desired moving speed for the print phase; and, when the minimum moving speed is less than the predetermined proportion of the second desired moving speed;

comparing the maximum moving speed with a sum of the second desired moving speed and a predetermined factor; and decreasing the pulse width by a third increment when the maximum moving speed is greater than the sum and determining if the maximum moving speed lies in a range between the sum and the second desired moving speed when the maximum moving speed is less than or equal to the sum.

20. The method according to claim 19, wherein when it is determined the maximum moving speed is within the range, the pulse width is not corrected and if the maximum moving speed is outside the range, increasing the pulse width by the third increment.

21. The method according to claim 19, wherein when the minimum moving speed is greater than or equal to the predetermined proportion of the second desired moving speed, further comprises the steps of:

calculating an average moving speed from the maximum moving speed and the minimum moving speed;

comparing the average moving speed to the second desired moving speed, decrementing the pulse width by the third increment when the average moving speed is greater than the second desired moving speed, and when the average moving speed is less than or equal to the second desired moving speed, comparing the minimum moving speed to the allowable minimum moving speed.

22. The method according to claim 21, when the minimum moving speed is less than the allowable minimum moving speed increasing the pulse width by the third increment.

23. The method according to claim 19, wherein the second increment is two units and the third increment is one unit.

* * * * *